US007635818B2

(12) United States Patent
McCaffrey

(10) Patent No.: US 7,635,818 B2
(45) Date of Patent: Dec. 22, 2009

(54) DIFFERENTIAL ADJUSTMENT MECHANISM FOR PRESSURE SWITCHES

(75) Inventor: Colin L. McCaffrey, Sherwood Park (CA)

(73) Assignee: Robinson Controls Inc.

( * ) Notice: Subject to any disclaimer, the term of this patent is extended or adjusted under 35 U.S.C. 154(b) by 111 days.

(21) Appl. No.: 12/101,409

(22) Filed: Apr. 11, 2008

(65) Prior Publication Data

US 2009/0255796 A1 Oct. 15, 2009

(51) Int. Cl.
*H01H 35/24* (2006.01)

(52) U.S. Cl. ..... 200/83 R; 200/83 S; 200/83 SA

(58) Field of Classification Search ..... 200/81 R, 200/82 R, 82 A, 82 C, 83 R, 83 A, 83 J, 83 Q, 200/83 S, 83 SA, 83 W
See application file for complete search history.

(56) References Cited

U.S. PATENT DOCUMENTS 3,194,916 A * 7/1965 Vischer, Jr. ..... 200/83 S
3,301,977 A * 1/1967 Simonin, Jr. ..... 200/82 R
3,325,613 A * 6/1967 Dunn et al. ..... 200/82 R
5,004,873 A * 4/1991 Schnut ..... 200/83 P
5,034,583 A * 7/1991 Benz et al. ..... 200/329
5,432,310 A * 7/1995 Stoeger ..... 200/82 R
5,554,834 A 9/1996 Ellett
5,670,766 A 9/1997 Ellett
5,744,771 A * 4/1998 Ellett ..... 200/83 J
7,297,885 B2 * 11/2007 Lee ..... 200/83 R
7,475,443 B2 * 1/2009 Wang ..... 5/713

OTHER PUBLICATIONS

Barber Industries, Presco-Switch, Bulletin No. 600, undated (4 pages), Jan. 1982.
Barber Industries Canada, Presco Pressure Control Switch, Bulletin No. 600-2, undated (4 pages), Nov. 1979.

* cited by examiner

*Primary Examiner*—Michael A Friedhofer
(74) *Attorney, Agent, or Firm*—Donald V. Tomkins

(57) ABSTRACT

A calibration mechanism for setting the tripping point of a microswitch in a pressure switch has a lower collar fixed to the upper end of the pressure switch push rod, and an upper collar disposed above the lower collar and adapted to actuate the trigger of the microswitch when raised a sufficient distance above the lower collar. The upper and lower collars each have a threaded bore, each with a different thread pitch, plus guide means for keeping the threaded bores aligned for receiving a double-threaded adjustment screw having an upper section threaded to engage the upper collar's threaded bore, and a lower end threaded to engage the lower collar's threaded bore. Due to the different thread pitches, rotation of the adjustment screw will cause gradual movement of the upper collar either toward or away from the lower collar, thus facilitating fine adjustment of the microswitch trigger point. The calibration mechanism may also include a reset mechanism, operable on similar principles to set the microswitch's reset point.

11 Claims, 7 Drawing Sheets

DIFFERENTIAL ADJUSTMENT MECHANISM FOR PRESSURE SWITCHES

FIELD OF THE INVENTION

The present invention relates in general to pressure-actuated switches for interrupting an electrical circuit in response to changes in pressure in a fluid flow line or vessel, and relates in particular to mechanisms for calibrating and resetting such switches.

BACKGROUND OF THE INVENTION

Pressure switches are widely used in industrial applications relating to process fluids. They are used to regulate pump and compressor operation as well as liquid levels in tanks within specific predetermined pressure ranges. These pressure switches typically have two set points: a high (or tripping) pressure, and a low (or reset) pressure.

Oilfield pumps and vessels containing liquid are common applications for pressure switches. Oilfield pumps are set up with a pressure switch located in the discharge line to detect high and low pressures. When the pressure within the discharge line senses the tripping pressure, the switch triggers the pump to shut down. When the line pressure drops below the reset pressure, the switch will trigger the pump to resume operation.

Another common application for pressure switches is in association with a tank containing liquid, where a pump is required to fill or empty the vessel. A pressure switch allows the operator to set the pump to operate automatically within specific liquid head pressures.

As may be seen by way of example in U.S. Pat. Nos. 5,554,834 and 5,670,766, a conventional pressure switch typically features an electrical enclosure at its upper end and a spring body and process connection at its lower end, which is mountable to an opening in a pipeline, vessel, or other component containing a fluid. A metal push rod is slidably mounted within the spring body housing, with its lower end operatively engaged with a metal piston and metal diaphragm assembly which closes off the process connection, such that the diaphragm will be exposed to pressure from the pipeline or vessel. The upper end of the push rod extends into the electrical enclosure. An electrical microswitch is disposed within the electrical enclosure and securely fastened to a mounting bracket. The microswitch has conventional contacts for wiring to whatever electrically-actuated device the pressure switch, is intended to control. The microswitch also has, on its lower side, a plunger or trigger which when pressed into the microswitch (i.e., upward relative to the enclosure) will trip the microswitch.

The assembly described above is configured such that upward movement of the piston is transferred to the push rod in response to external fluid pressure applied to the diaphragm, such that the push rod trips the microswitch. The specific mechanism used to translate push rod movement into trigger movement may vary from one manufacturer to the next.

A conventional pressure switch typically incorporates a spring assembly including a helical spring of suitable stiffness, disposed around the push rod and extending between the diaphragm end of the push rod and an upper abutment within the enclosure. This spring assembly provides a resistive force necessary to maintain a specific range of pressure to both trip and reset the device. Accordingly, a higher tripping pressure will entail a higher degree of spring, compression. To facilitate adjustment of the spring compression, the aforementioned abutment is longitudinally movable within the pressure switch housing.

One of the critical challenges in the design of pressure switches is to provide for accurate and reliable pre-setting of desired tripping and reset pressures, which essentially boils down to finely controlled adjustment of the gap between the microswitch and push rod assembly.

In some pressure switch designs, the microswitch could be tripped by effectively direct actuation of the trigger by the upper end of the push rod; in such designs, however, accurate control of the gap between the push rod and microswitch trip button would be difficult, since it would require the components to be machined to unrealistic tolerances.

In other designs, a deformable offset trip plate (typically made of steel) may be provided in association with the microswitch such that the trigger is laterally offset from the axis of the push rod, but upward movement of the push rod will raise the free end of the trip plate, in turn causing another portion of the trip plate to exert an upward force on the trigger. However, this involves a tedious and time-consuming trial-and-error procedure. With the switch partially disassembled, the trip plate must be bent into a trial position, whereupon the switch is reassembled and connected to an external pressure source to determine the actual tripping pressure that corresponds to the trip plate position. If the gap between the push rod and the microswitch is too wide or too narrow, the switch must be disassembled again so that the trip plate can be bent one way or the other into a new trial position, and then the switch is reassembled and tested again. This procedure is followed until the trip plate is in a position that produces the appropriate gap between the push rod and the microswitch.

For the foregoing reasons, there is a need for a pressure switch calibration mechanism that facilitates fine adjustment of the gap between the push rod and microswitch more easily and more quickly than is possible with typical conventional switches, and without need for trial-and-error methods. The present invention is directed to this need.

BRIEF DESCRIPTION OF THE INVENTION

In one aspect, the present invention is a calibration mechanism for fine adjustment of the tripping point of a microswitch (or other suitable mechanically-actuated electrical switching device) associated with a pressure switch. The calibration mechanism includes a lower collar that is mountable to the upper end of the push rod of the pressure switch, and an upper collar that is vertically movable relative to the lower collar by means of a double-threaded calibration adjustment screw that has a lower section threadingly engageable with a threaded bore in the lower collar, and ah upper section threadingly engageable with a threaded bore in the upper collar.

The pitches of the upper and lower threads of the lower section of the calibration adjustment screw are slightly different, such that rotation of the adjustment screw in a first direction (typically but not necessarily clockwise) will cause the upper collar to move toward the lower collar, and rotation in the opposite direction will move the upper collar away from the lower collar. If the thread, pitches were identical, the relative movement between the collars would be zero. Therefore, for a given amount of rotation of the calibration adjustment screw, the differing thread pitches will cause the collars to travel at different rates along the calibration adjustment screw as it is rotated.

The differential thread pitch between the upper and lower collars thus facilitates fine adjustment of the position of the upper collar relative to the push rod. The precision with which relative movement of the upper collar can be controlled will depend on the absolute values of the two thread pitches as well as the difference between them. For example, if the pitch of the lower section of the calibration adjustment screw (i.e., the section that engages the lower collar) is 20 threads per inch (tpi), and the pitch of the upper section (which engages the upper collar) is 24 tpi, each full rotation of the calibration adjustment screw will change the distance between the two collars by $1/20^{th}$ of an inch (0.05") minus $1/24^{th}$ of an inch (0.04166"), or only 0.00833 inches, even though the screw is withdrawn 0.05" from the lower collar. If the lower and upper thread pitches are changed to 12 tpi and 16 tpi respectively, each full rotation of the calibration adjustment screw will change the distance between the two collars by $1/12^{th}$ of an inch (0.08333") minus $1/16^{th}$ of an inch (0.06250"), or 0.02083 inches, which is considerably greater than in the first example even though the thread pitch differential is 4 tpi in both cases. Accordingly, the absolute and differential values of the thread pitches may be selected to suit the degree of calibration precision desired for a given switch application.

The calibration mechanism is provided with guide means whereby the upper collar will remain aligned with the lower collar as it moves toward or away from the lower collar in response to rotation of the calibration adjustment screw. A preferably upset portion of the upper surface of the upper collar (the "switch contact area") is configured or adapted for contacting the trigger on the lower side of the microswitch.

To calibrate a pressure switch incorporating the calibration mechanism of the present invention, the lower end of the switch is connected to a pressure source corresponding to the desired tripping pressure for the switch. The calibration adjustment screw is rotated as required to minimize the gap between the upper and lower collars, and the longitudinal position of the push rod within the electrical enclosure is coarsely set such that the switch contact area is disposed slightly below the microswitch trigger (or in contact with the trigger without tripping it). Rotation of the Calibration adjustment screw in the appropriate direction will then raise the switch contact area of the upper collar so as to depress the trigger until the trigger actuates the microswitch, at which point rotation of the calibration adjustment screw is stopped. The pressure switch is how calibrated to trip at the desired tripping pressure.

In preferred embodiments, the calibration mechanism also incorporates a reset mechanism for use in conjunction with a microswitch having a reset button on its upper side. As will be explained in greater detail further on in this specification, the reset mechanism employs functional principles similar to those used in the calibration mechanism. The reset mechanism includes a crossbar disposed transversely above the reset button and supported so as to move in accordance with longitudinal movements of the push rod. The crossbar has a threaded bore for engaging the upper section of a double-threaded reset adjustment screw. Also provided is a reset contact button disposed generally below the crossbar but with a transverse slot on its upper side, such that the crossbar fits within the slot while leaving the contact button free to move longitudinally relative to the crossbar, but at the same time substantially prevented from rotating relative to the crossbar. The contact button has a threaded bore extending downward from the bottom of the slot and alignable with the threaded bore of the crossbar when the crossbar is disposed within the slot.

The thread pitch in the contact button is slightly different from the thread pitch in the crossbar, correspondingly, the lower section of the reset adjustment screw will have a thread pitch different from that of the upper section. Accordingly, rotation of the reset adjustment screw in a first direction (typically but not necessarily clockwise) will cause the contact button to move away from the crossbar and toward the microswitch, thus causing the contact button to depress the reset button on the microswitch. It follows that rotation of the reset adjustment screw in the opposite direction will move the contact button upward relative to the crossbar, such that continued upward movement of the contact button will cause it to move away from the microswitch reset button resulting in a wider reset point for the switch. This adjustment provides movement necessary to set a specific reset point for the microswitch, thus setting the desired "dead band" for a given application (i.e., the pressure range within which the controlled electrical device will not operate).

If, for example, it is desired for a pressure switch to trip when the pressure in a pipeline to which it is mounted reaches 500 pounds per square inch (psi), and it is further desired for the microswitch to be automatically reset when the pipeline pressure falls to 300 psi, the pressure switch is calibrated as previously described, with the switch being exposed to a pressure source set at 500 psi. The pressure source is then reduced to 300 psi, whereupon the reset adjustment screw is rotated as required until it depresses the reset button and thus resets the microswitch. The pressure switch is then ready to enter service in an actual field application.

BRIEF DESCRIPTION OF THE DRAWINGS

Embodiments of the invention will now be described with reference to the accompanying figures, in which numerical references denote like parts, and in which.

DETAILED DESCRIPTION OF THE PREFERRED EMBODIMENT

Figure 1:
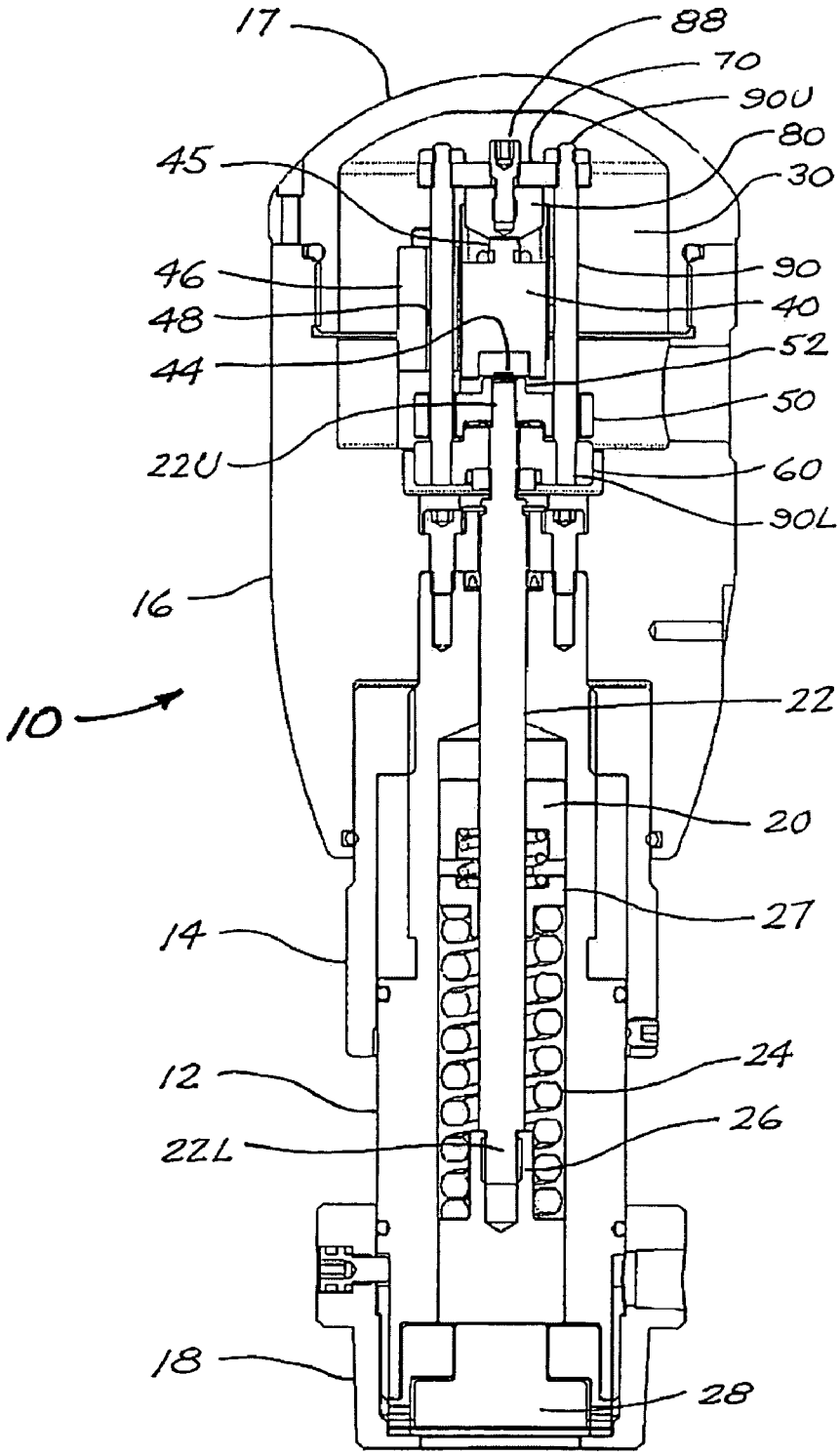
FIG. 1 is a first longitudinal cross-section through a pressure switch having calibration and reset mechanisms in accordance with one embodiment of the present invention.
Figure 2:
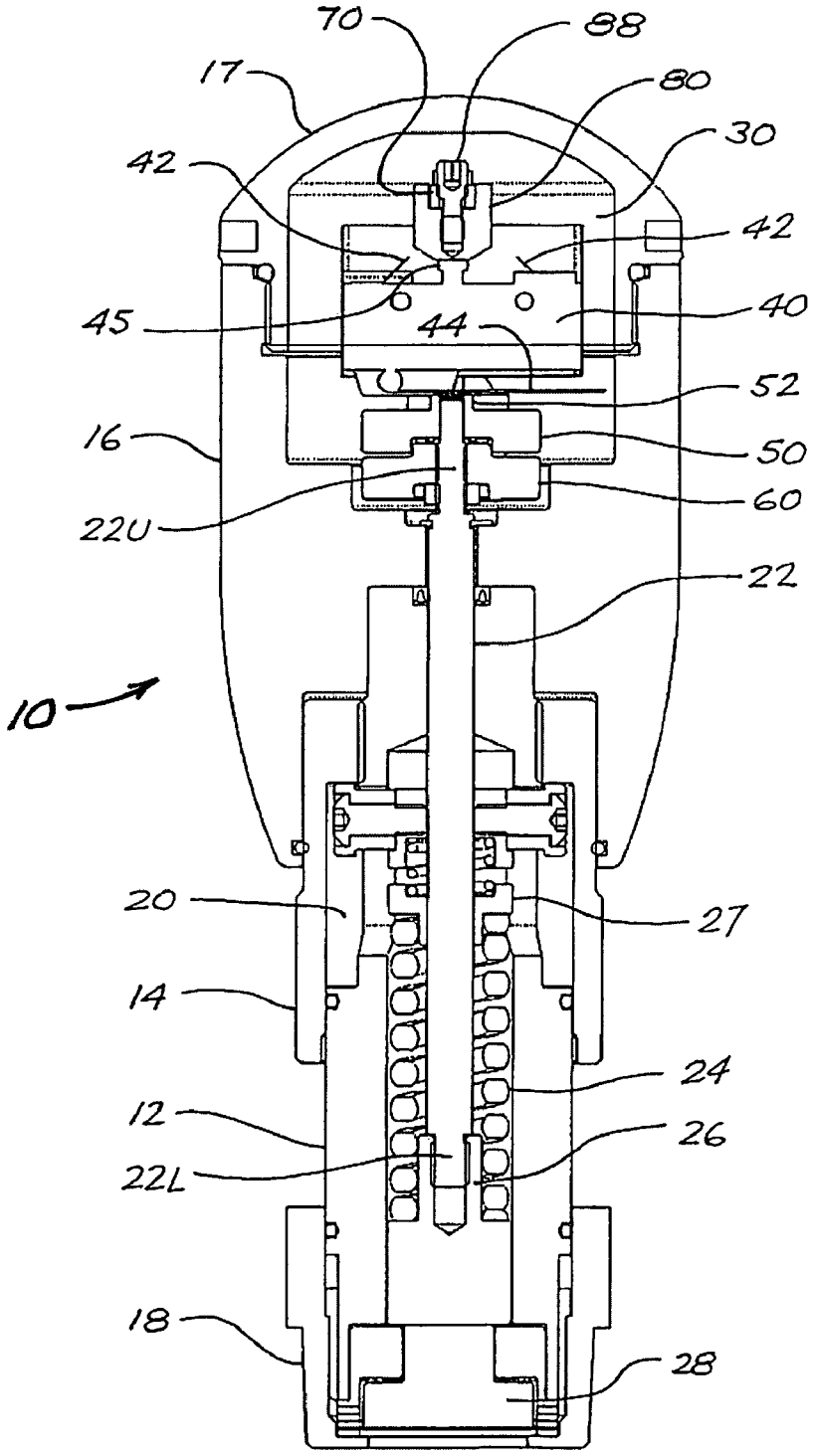
FIG. 2 is a longitudinal cross-section through the pressure switch shown in FIG. 1, taken at 90 degrees to the cross-section of FIG. 1.

FIGS. 1 and 2 are cross-sections (taken 90 degrees to each other) through a pressure switch 10 incorporating calibration and reset mechanisms in accordance with one embodiment of the present invention. Pressure switch 10 comprises a lower switch body 12 which encloses a longitudinally-oriented spring chamber 20 which is open at its lower end. A diaphragm assembly 28 is disposed within the lower region of spring chamber 20 so as to effectively close off the open lower end thereof. A suitable fitting 18 is provided at the lower end of lower switch body 12 for connection to a pressurized pipeline, pressure vessel, or the like, such that diaphragm assembly 28 will be exposed to whatever fluid pressure is in the pipeline or pressure vessel. A piston 26 is provided in association with diaphragm assembly 28, with piston 26 being slidingly movable within spring chamber 20. A push rod 22 is disposed within spring chamber 20, with its upper end 20U slidably projecting through the upper end of lower switch body 12, and with its lower end 20L engaging piston 26 such that transverse deformations of diaphragm assembly 28 in response to external pressure will cause corresponding longitudinal movement of push rod 22 relative to lower switch body 12 (in accordance with technologies well known in the art of pressure switches).

A helical spring 24 is disposed around push rod 22 within spring chamber 20, for regulating the amount of external pressure required to move the push rod (i.e., the required or desired spring compression will increase with the desired tripping pressure of pressure switch 10). In the pressure switch shown in FIGS. 1 and 2, the lower end of spring 24 bears against piston 26 and the upper end of spring 24 bears, against an upper spring abutment 27 that is movable longitudinally within spring chamber 20. The degree of compression in spring 24 is adjustable by rotation of a spring adjustment sleeve 14 which is disposed around an upper region of lower switch body 12 and threadingly engaged therewith. Sleeve 14 is operatively linked with upper spring abutment 27 (in accordance with well-known methods) such that rotation of sleeve 14 in a first direction (typically but not necessarily clockwise) will compress spring 24, and rotation of sleeve 14 in the opposite direction will relieve compression an spring 24.

The foregoing components of pressure switch 10 have been described in general and representative terms only, because the specific details of these components are not directly relevant to the present invention. The construction of lower switch body 12 and its various components can generally conform with known technology in the field of pressure switches without affecting the scope of the present, invention. What is important for specific purposes of the present invention is that pressure switch 10 has a push rod 22 which is slidable within lower switch body 12 in response to external pressure acting on diaphragm assembly 28.

Figure 3:
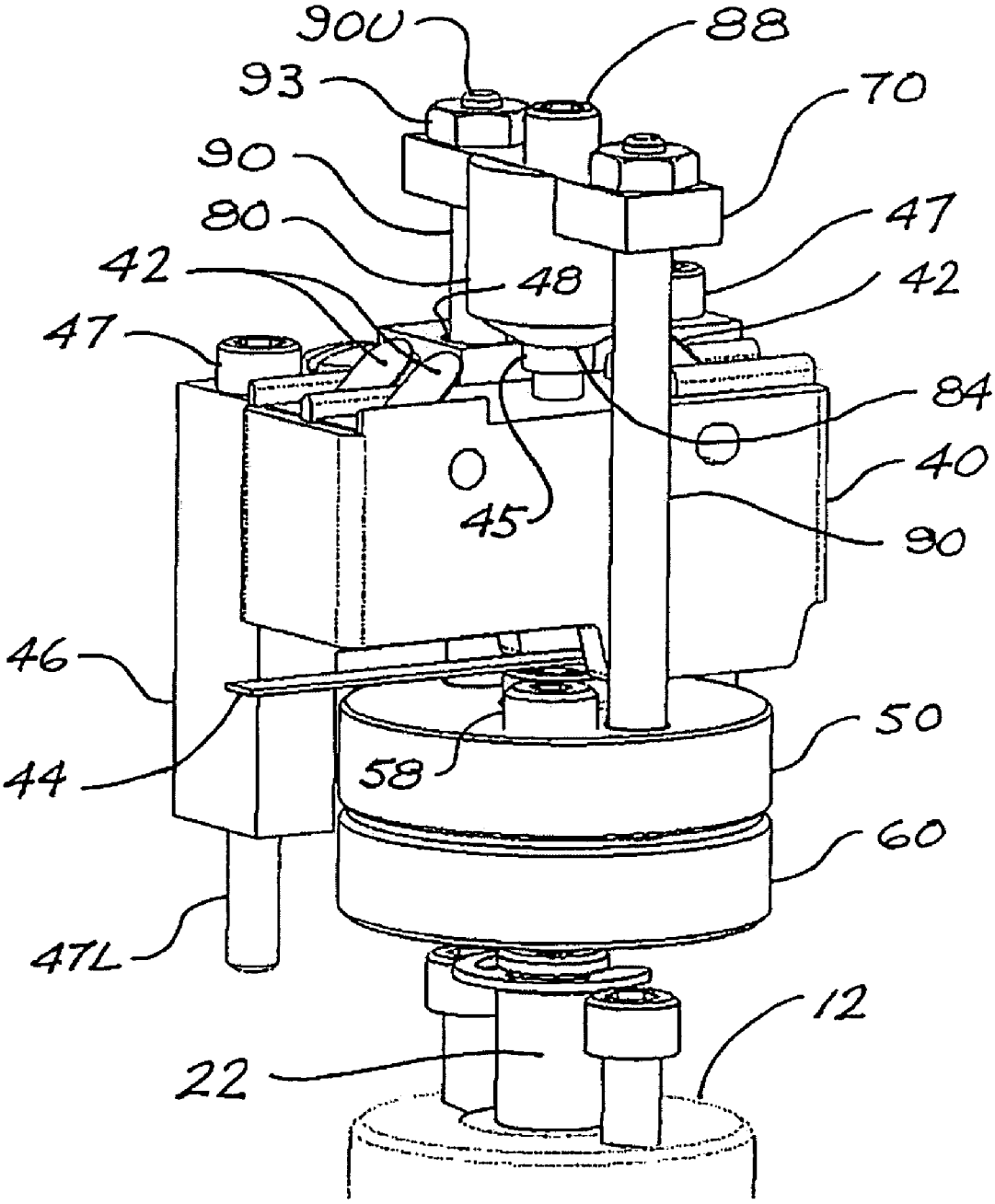
FIG. 3 is a perspective view of calibration and reset mechanisms in accordance with an embodiment of the present invention, shown assembled in conjunction with a microswitch having a reset button.

Pressure switch 10 also comprises an upper switch body 16 which is engageable with lower switch body 12 and which has a removable cover section 17. Upper switch body 16 and cover section 17, when assembled, define a switch chamber 30 in which a microswitch 40 is mounted. As best seen in FIG. 3, microswitch 40 has multiple electrical contacts 42 for wiring to an electrical device (hot shown) controlled by pressure switch 10. On its lower side, microswitch 40 has a trigger 44 which upon being upwardly depressed will trip microswitch 40 and thus disconnect the connected electrical device. Microswitch 40 may also have a reset button 45 which may be downwardly depressed to reset microswitch 40 after it has been tripped, thus allowing the controlled electrical device to be reset and resume operation (until such time as microswitch 40 is tripped again).

FIG. 3 illustrates calibration and reset mechanisms in accordance with one embodiment of the present invention, mounted in conjunction with microswitch 40. The individual components of the calibration and reset mechanisms are perhaps most readily understandable from FIGS. 4 and 5, which illustrate the calibration and reset mechanisms in isolation from microswitch 40. In the embodiment shown in FIG. 3, microswitch 40 is mounted to a mounting block 46 which has vertical bores or holes to receive mounting bolts 47, the lower ends 47L of which are matingly engageable with threaded bores in a portion of lower switch body 12 (or a suitable appurtenance rigidly connected thereto).

Referring now to FIGS. 3, 4, 5, 6A, 6B, 7A, and 7B, the calibration mechanism of the invention comprises a lower collar 60, preferably (but not necessarily) in the form of a generally disc-shaped element having an upper surface 60U and a lower surface 60L. In preferred embodiments, a centrally located (and preferably cylindrical) abutment 62 extends upward from upper surface 60U, and a center bore 63 extends through the full thickness of lower collar 60 and abutment 62. Additional features of lower Collar 60, in its preferred embodiment, are illustrated in further detail in FIGS. 7A and 7B.

Lower collar 60 is connected to the upper end 22U of push rod 22. In the illustrated preferred embodiment, this correction is facilitated by providing a threaded section on upper end 22U of push rod 22, and by providing mating threads in at least a portion of center bore 63 of lower collar 60, thus allowing lower collar 60 to be screwed securely onto upper end 22U of push rod 22. However, lower collar 60 could be connected to push rod 22 by other means (e.g., press fit; splined connection; welding) without departing from the present invention. A pair of guide rod holes 61 extend downward from upper surface 60U into the thickness of lower collar 60, One on either side of threaded bore 63. Also provided is a threaded bore 66 extending downward from upper surface 60U into the thickness of lower collar 60, with threaded bore 66 having a first thread pitch.

Figure 6A:
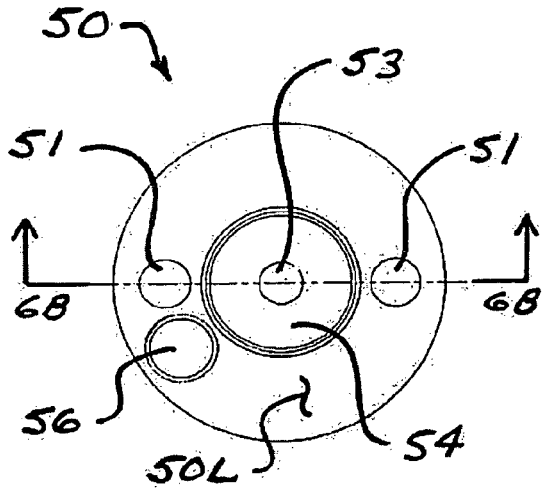
FIGS. 6A and 6B are, respectively, an upward-looking view of the lower side of the upper collar of the calibration mechanism of FIG. 4, and a transverse cross-section through same.
Figure 6B:
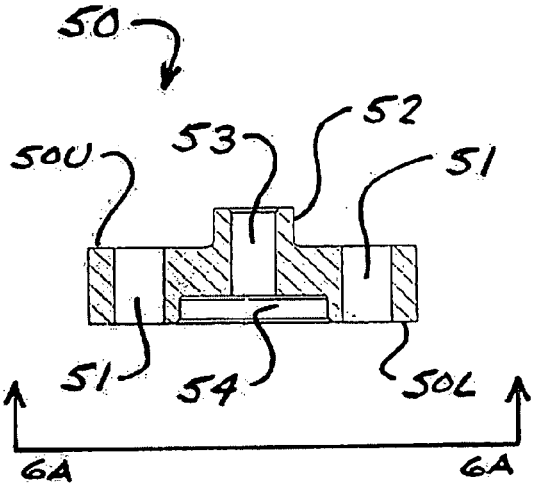
Figure 7A:
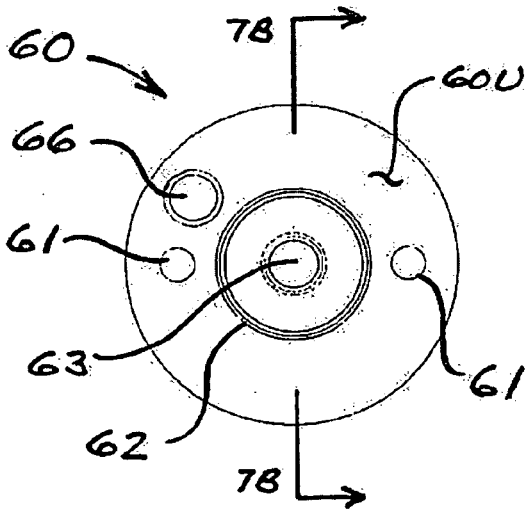
FIGS. 7A and 7B are, respectively, a plan view of the upper side of the lower collar of the calibration mechanism of FIG. 4, and a transverse cross-section through same.
Figure 7B:
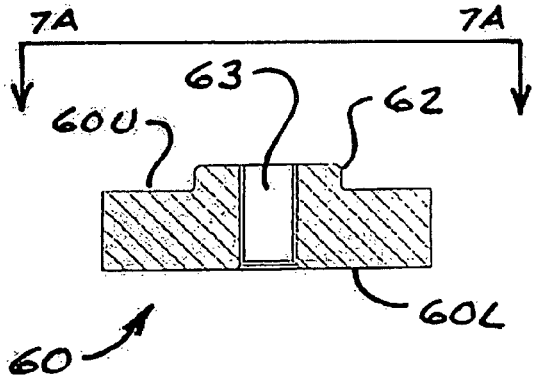

The calibration mechanism also includes an upper collar 50 which is preferably (but not necessarily) disc-shaped, with ah upper surface 50U and a lower surface 50L. As best seen in FIGS. 6A and 6B, upper collar 50 preferably has a recess 54 set into its lower surface 50L, sized and configured to receive abutment 62 of lower collar 60 in a sliding tolerance fit, thereby helping to keep upper collar 50 and lower collar 60 in coaxial alignment when upper collar 50 moves relative to lower collar 60. Although not shown, a spring washer may optionally be; disposed between abutment 62 and the "roof" of cylindrical recess 54, to help keep upper collar 50 generally parallel to lower collar 60.

Upper collar 50 also preferably has a centrally-positioned upstand 52 projecting above upper surface 50U, and a centrally-positioned smooth bore 53 extending through upstand 52 and intercepting cylindrical recess 54. Smooth bore 53 is provided to receive, in a sliding tolerance fit, an unthreaded section of upper end 22U of push rod 22, above the threaded portion of upper end 22U. This feature is advantageous as further means to help keep upper collar 50 in true alignment with lower collar 60, but it is optional and not essential to the invention. In alternative variants, upper end 22U of push rod 22 need not extend above lower collar 60 so long as means are provided for keeping upper collar 50 in substantial alignment with lower collar 60.

Upper collar 50 has a pair of guide rod holes 51 extending through the full thickness of upper collar 50, and sized and spaced to match guide rod holes 61 in lower collar 60. Upper collar 50 also has a treaded bore 56 extending downward from upper surface 50U and through the full thickness of upper collar 50, with threaded bore 56 having a second thread pitch different from the previously mentioned first, thread pitch of threaded bore 66 of lower collar 60 (i.e., the first and second threads have different numbers of threads per inch).

Figure 4:
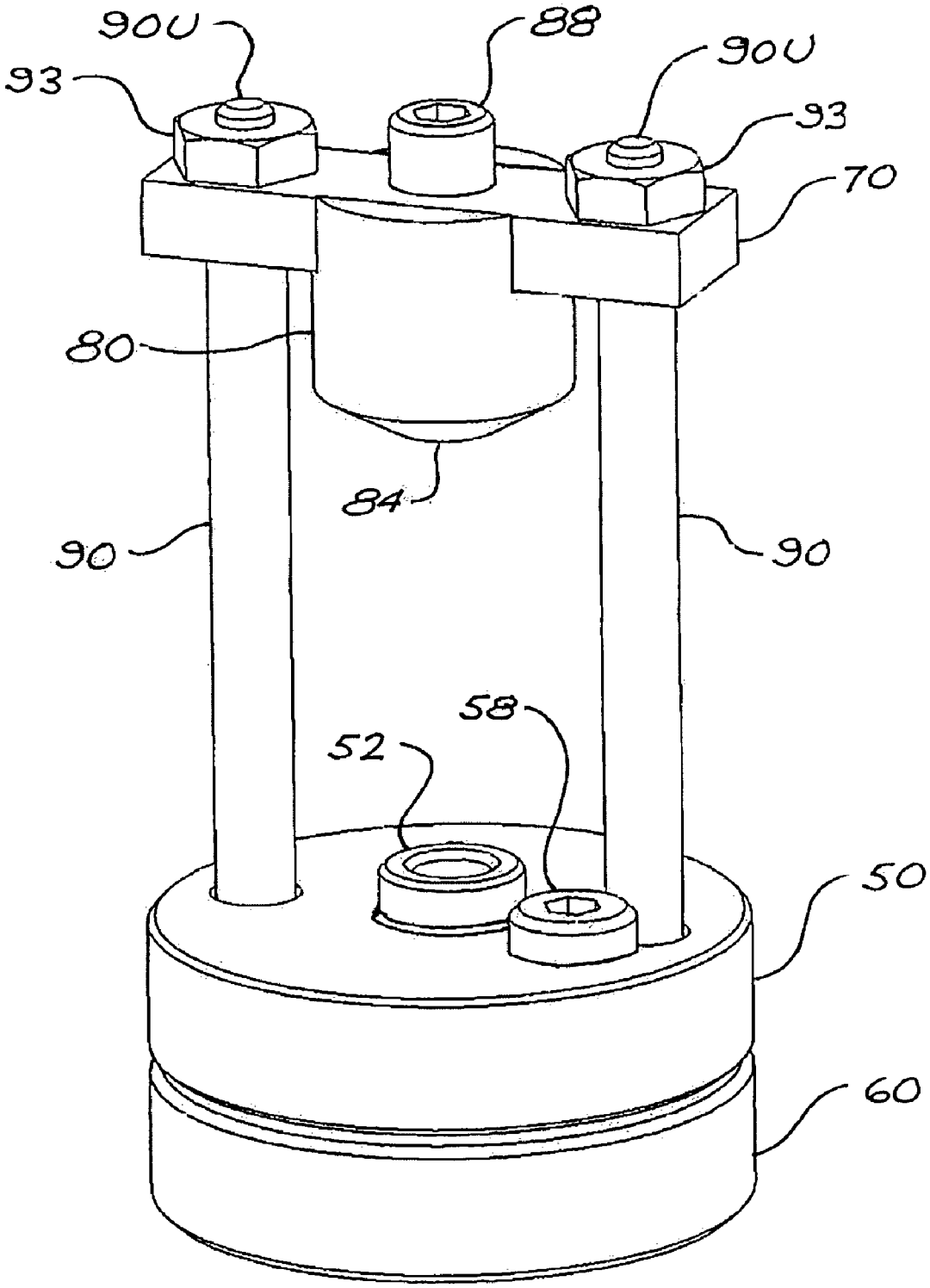
FIG. 4 is a perspective view of the calibration and reset mechanisms shown in FIG. 3, shown in isolation.
Figure 5:
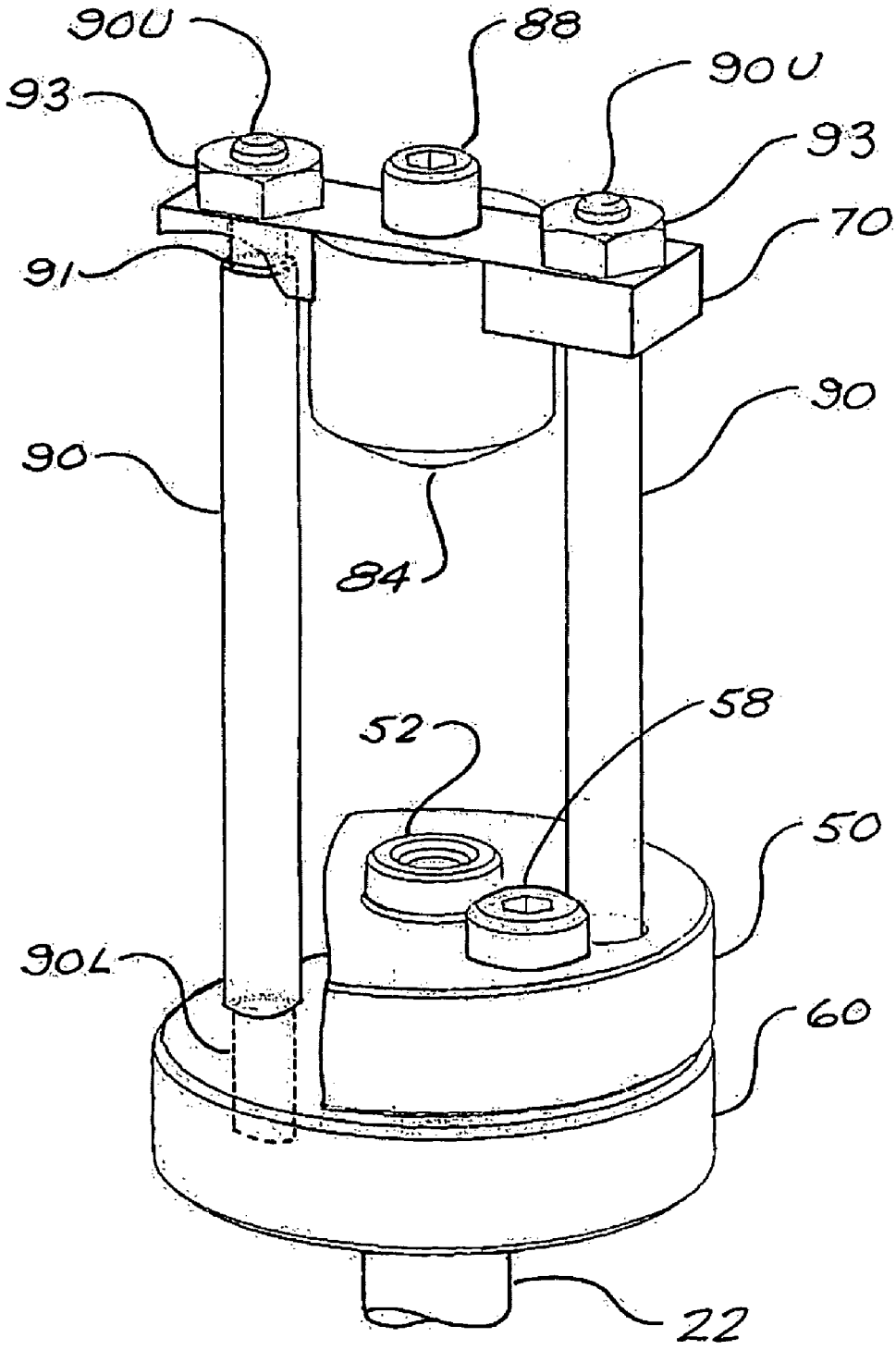
FIG. 5 is a partially cutaway view of the calibration and reset mechanisms shown in FIG. 4, shown installed on the upper end of a pressure switch push rod.

The assembly of the calibration mechanism can now be readily understood with reference to FIGS. 3, 4, and 5. A pair of guide rods 90 are provided, each having a lower end 90L and an upper end 90U. Guide rods 90 are connected to lower collar 60 by securing their lower ends 90L into guide rod holes 61 (by means of a threaded connection or a press fit, or other effective means), thus leaving guide rods 90 projecting upward from lower collar 60. Upper collar 50 may then be slipped over guide rods 90 (which slide through guide rod holes 51), thus positioning upper collar 50 directly above lower collar 60 (with abutment 62 of lower collar 60 nested within cylindrical recess 54 of upper collar 50, in the preferred embodiment) and with threaded bores 56 and 66 in axial alignment. A double-threaded calibration adjustment screw 58 may then be used to precisely adjust the position of upper collar 50 relative to lower collar 60, as will be described below.

The assembled calibration mechanism is mounted to pressure switch 10 by connecting lower collar 60 to upper end 22U of push rod 22 (by twisting lower collar 60 onto the threaded portion of upper end 22U in preferred embodiments, or by other effective means). Microswitch 40 is then mounted so as to be disposed between guide rods 90 generally as shown in FIGS. 1 and 3, with upstand 52 of upper collar 50 positioned below trigger 44 of microswitch 40. As previously noted, and as may be seen in FIGS. 1 and 3, the mounting of microswitch 40 within pressure switch 10 may be facilitated by providing a mounting block 46 which has vertical bores to receive mounting bolts 47, the lower ends 47L of which are matingly engageable with threaded bores in a portion of lower switch body 12. In the illustrated embodiment, mounting block 46 has an additional bore 48 which passes over one of the guide rods 90 when microswitch 40 is installed, thereby helping microswitch 40 maintain a fixed lateral position relative to the calibration mechanism. Notwithstanding the benefits of the configuration discussed above, however, the use of a mounting block is not essential to the invention. Persons skilled in the art will appreciate that other ways or means for installing microswitch 40 in operative association with the calibration mechanism of the invention can be readily devised.

Figure 8:
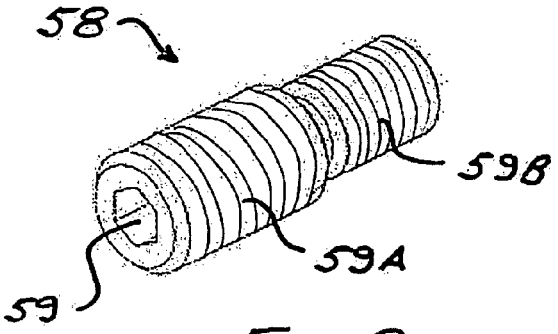
FIG. 8 is a perspective view of a calibration adjustment screw for use in association with the calibration mechanism shown in FIG. 4.

As best seen in FIG. 8, calibration adjustment screw 58 has an upper section 58A threaded to mate with threaded bore 56 of upper collar 50, and a lower section 58B threaded to mate with threaded bore 66 of lower collar 60. Accordingly, lower section 58B has a different thread pitch than upper section 58A. In the preferred and illustrated embodiment, the diameter of lower section 58B is less than that of upper section 58A—and the diameter of threaded bore 66 is therefore less than that of threaded bore 56—so that lower section 58B can pass through threaded bore 56 without interference in order to engage threaded bore 66. The upper end of calibration adjustment screw 58 is provided with suitable drive means 59 (shown by way of example as a hex socket) whereby calibration adjustment screw 58 may be rotated to raise or lower upper collar 50 relative to lower collar 60, in accordance with the direction of rotation.

Although calibration adjustment screw 58 has been described and illustrated herein as having upper section 58A larger in diameter than lower section 58B (with threaded bore 66 being corresponding larger in diameter than threaded bore 56), this arrangement is not essential to the invention. Persons skilled in the art will appreciate that variant embodiments can be readily devised in which upper section 58A and lower section 58B are of the same diameter, or in which upper section 58A is smaller in diameter than lower section 58B.

It would be possible to assemble a pressure switch that incorporates only the calibration mechanism of the present invention, in accordance with the foregoing description. In such variants, guide rods 90 could be considerably shorter than those shown in the drawings; they would only need to be long enough to maintain upper collar 50 in substantial alignment with lower collar 60 through the upper collar's range of movement relative to lower collar 60. In preferred embodiments, however, a reset mechanism is also provided in conjunction with the calibration mechanism, and in order to accommodate the reset mechanism, guide rods 90 are extended to a suitable distance above microswitch 40 as shown in FIGS. 3-5.

Figure 9:
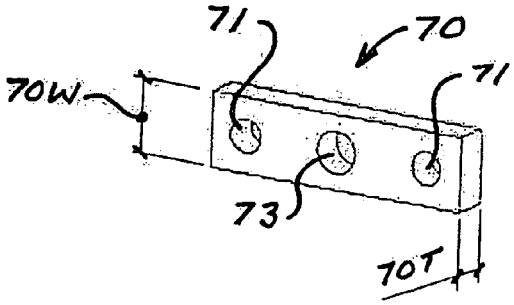
FIG. 9 is a perspective view of the crossbar of the reset mechanism shown in FIG. 4.

The reset mechanism of the invention employs functional principles similar to those used in the calibration mechanism, and its construction and operation may be understood with particular reference to the preferred embodiments illustrated in FIGS. 3, 4, 5, 9, 10A, 10B, and 11. The reset mechanism includes a crossbar 70 that spans transversely across the upper ends 90U of guide rods 90. Crossbar 70 is shown as being of rectilinear configuration, but this is hot essential; crossbar 70 could take other shapes without departing from the concept of the invention, hi the preferred configuration shown in FIGS. 4, 5, and 9, crossbar 70 is provided with guide rod holes 71 for receiving upper ends 90U of guide rods 90, with upper ends 90U each having a shoulder 91 for bearing against the underside of crossbar 70, and having a threaded portion extending above crossbar 70 to receive a nut 93, thereby securing crossbar 70 to guide rods 90. However, this particular means of attachment is not essential to the invention; other effective ways of securing crossbar 70 to guide rods 90 may be devised in accordance with common general knowledge in the field of the invention. As best seen in FIG. 9, crossbar 70 has a threaded bore 73, the purpose of which is described in further detail below.

Figure 10A:
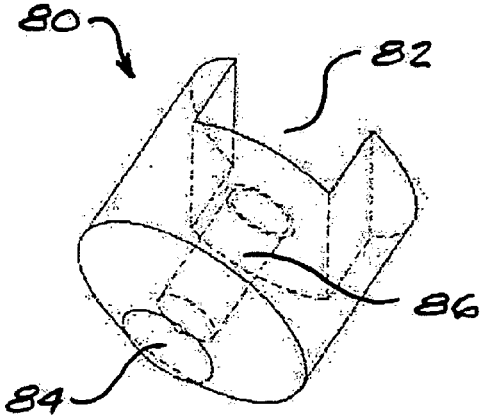
FIGS. 10A and 10B are, respectively, a perspective view of the contact button of the reset mechanism shown in FIG. 4, and a transverse cross-section through same.
Figure 10B:
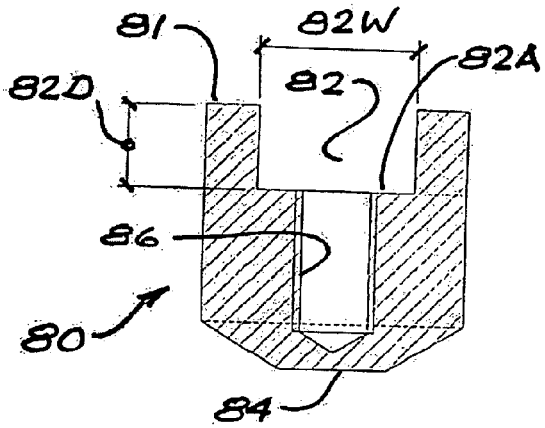

The reset mechanism also includes a reset contact button 80, which as best seen in FIGS. 10A and 10B is preferably (but not necessarily) of a generally cylindrical configuration, and has an upper surface 81 and a lower surface 84. Contact button 80 is formed with a transverse slot 82 formed into the upper face 81 of contact button 80 and sized such that crossbar 70 can be disposed within slot 82 while leaving contact button 80 free to move longitudinally (i.e., parallel to guide rods 90) relative to crossbar 70 but substantially prevented from rotating relative to crossbar 70. Accordingly, the width 82W of slot 82 will preferably be only slightly larger than the width 70W of crossbar 70. The depth 82D of slot 82 is preferably approximately equal to the thickness 70T of crossbar 70, but this relationship is not critical or essential to the invention; i.e., in variant embodiments of contact button 80, slot depth 82D could be either greater or smaller than crossbar thickness 70T, so long as the crossbar's aforementioned non-rotatability and freedom of longitudinal movement are maintained.

Figure 11:
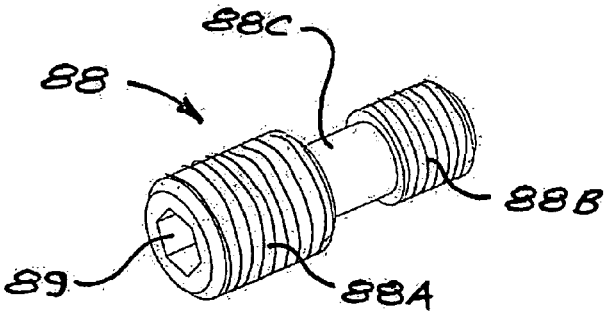
FIG. 11 is a perspective view of a reset adjustment screw for use in association with the reset mechanism of FIG. 4.

Contact button 80 has a threaded bore 86 extending downward from the base 82A of slot 82 and positioned for alignment with threaded bore 73 of crossbar 70 when crossbar 70 is disposed within slot 82. The pitch of the threads in threaded bore 86 in contact button 80 is slightly different from the pitch of the threads in threaded bore 73 of crossbar 70. To provide for selective movement of contact button 80 relative to crossbar 70, the reset mechanism includes a double-threaded reset adjustment screw 88, illustrated by way of example in FIG. 11. Reset adjustment screw 88 has an upper section 88A threaded to mate with threaded bore 73 of crossbar 70 and a lower section 88B threaded to mate with threaded bore 86 of contact button 80. Reset adjustment screw 88 may also have a neutral, unthreaded section 88C as shown in FIG. 11. Lower section 88B has a different thread pitch than upper section 88A. In the preferred and illustrated embodiment, the diameter of lower section 88B is less than that of upper section 88A—and the diameter of threaded bore 73 of crossbar 70 is therefore greater than that of threaded bore 86 in contact button 80—such that lower section 88B of reset adjustment screw 88 can pass through threaded bore 73 of crossbar 70 without interference in order to engage threaded bore 86 of contact button 80. The upper end Of reset adjustment screw 88 is provided with suitable drive means 89 (shown by way of example as a hex socket) whereby reset adjustment screw 88 may be rotated to raise or lower contact button 80 relative to crossbar 70, in accordance with the direction of rotation.

Although calibration adjustment screw 88 has been described and illustrated herein as having upper section 88A larger in diameter than lower section 88B (with threaded bore 73 being corresponding larger in diameter than threaded bore 86), this arrangement is not essential to the invention. Persons skilled in the art will appreciate that variant embodiments can be readily devised in which upper section 88A and lower section 88B are of the same diameter, or in which upper section 88A is smaller in diameter than lower section 88B.

The operation of the calibration and reset mechanisms of the present invention may be particularly well understood with reference to FIG. 3, which shows these mechanisms installed in association with a microswitch 40 as described above. Lower collar 60 is connected to the upper end 22U of push rod 22. Upper collar 50 is disposed above lower collar 60 and connected thereto by double-threaded calibration adjustment screw 58, which is disposed to one side of microswitch 40 to permit access to drive means 59 of calibration adjustment screw 58. Upstand 52 of upper collar 50 is disposed directly below trigger 44 of microswitch 40. Reset contact button 80 is connected to crossbar 70 such that lower surface 84 of contact button 80 is disposed directly above reset button 45 of microswitch 40. The lower end of pressure switch 10 is connected (by means of fitting 18) to a pressure source corresponding to the desired tripping pressure. Calibration adjustment screw 58 is rotated in the appropriate direction so as to raise upper collar 50 until upstand 52 trips trigger 45, thus setting microswitch 40 to trip at the desired tripping pressure. The pressure source is then reduced to a desired reset pressure, and reset adjustment screw 88 is rotated as required to lower reset contact button 80 until lower surface 84 of contact button 84 depresses reset button 45 of microswitch 40, thus setting microswitch 40 to be reset at the desired reset pressure.

It will be readily appreciated by those skilled in the art that various modifications of the present invention may be devised without departing from the essential concept of the invention, and all such modifications are intended to come within the scope of the present invention and the claims appended hereto. It is to be especially understood that the invention is not intended to be limited to illustrated embodiments, and that the substitution of a variant of a claimed element or feature, without any substantial resultant change in the working of the invention, will not constitute a departure from the scope of the invention.

In this patent document, the word "comprising" is used in its non-limiting sense to mean that items following that word are included, but items not specifically mentioned are not excluded. A reference to an element by the indefinite article "a" does not exclude the possibility that more than one of the element is present, unless the context clearly requires that there be one and only one such element.

What is claimed is:

1. For use in a pressure switch having:

(a) a switch chamber;

(b) an electrical switch mounted within the switch chamber and having a mechanically-actuated trigger projecting therebelow; and (c) a push rod movable in response to changes in fluid pressure acting on the pressure switch, said push rod having an upper end extending into the switch chamber;

a calibration mechanism comprising:

(d) a lower collar having an upper surface, said lower collar having a threaded bore extending downward from said upper surface and having a first thread pitch;

(e) guide means associated with the lower collar;

(f) an upper collar having an upper surface and a lower surface, said upper collar being disposable above the lower collar and engageable with the guide means so as to be movable vertically relative to the lower collar while remaining in substantial alignment therewith, said upper collar having a threaded bore aligned with the threaded bore of the lower collar and having a second thread pitch which is different from said first thread pitch of the lower collar; and (g) a calibration adjustment screw having:

g.1 an upper section threaded for engagement with the threaded bore of the upper collar; and g.2 a lower section threaded for engagement with the threaded bore of the lower collar;

such that rotation of the calibration adjustment screw will cause the upper collar to move either upward away from or downward toward the lower collar, depending on the direction of rotation;

the calibration mechanism being mountable to a pressure switch by connecting the lower collar to the upper end of the pressure switch's push rod, with the upper collar positioned below the trigger of the electrical switch, such that the calibration adjustment screw can be rotated to raise the upper collar to depress said trigger.

2. The calibration mechanism of claim 1 wherein the guide means comprises two guide rods mountable to the lower collar and extending substantially vertically upward from the upper surface of the lower collar, and wherein the upper collar has guide rod holes for receiving said guide rods.

3. The calibration mechanism of claim 1 wherein an upstand projects from the upper surface of the upper collar, said upstand being positioned to actuate the trigger of the electrical switch upon sufficient rotation of the calibration adjustment screw in a first direction.

4. The calibration mechanism of claim 1 wherein the lower collar has an abutment projecting above its upper surface, and the lower surface of the upper collar has a recess configured to receive said abutment of the lower collar.

5. The calibration mechanism of claim 1 wherein the first thread pitch is coarser than the second thread pitch.

6. The calibration mechanism of claim 1 wherein the first thread pitch is finer than the second thread pitch.

7. The calibration mechanism of claim 1 wherein the lower section of the calibration adjustment screw has a smaller diameter than the upper section thereof.

8. The calibration mechanism of claim 2 wherein when the calibration, mechanism is mounted to a pressure switch, the guide rods extend above the pressure switch's electrical switch, and wherein the calibration mechanism further comprises a reset mechanism for use in association with an electrical switch having a mechanically-actuated reset button projecting thereabove, said reset mechanism comprising;

(a) a crossbar disposed above the electrical switch, spanning between and supported by the upper ends of the guide rods, said crossbar having a threaded bore;

(b) a contact button having a threaded bore, the pitch of which is different from that of the threaded bore of the crossbar; and (c) a reset adjustment screw having:

c.1 an upper section threaded for engagement with the threaded bore of the crossbar; and c.2 a lower section threaded for engagement with the threaded bore of the contact button;

wherein:

(d) the contact button is mountable below and in association with the crossbar by means of said reset adjustment screw, such that rotation of the reset adjustment screw will cause the contact button to move either downward away from or upward toward the crossbar, depending on the direction of rotation;

such that the reset adjustment screw can be rotated in a selected direction to lower the contact button to depress the reset button of the electrical switch.

9. The calibration mechanism of claim 8 wherein the thread pitch of the threaded bore of the crossbar is coarser than the thread pitch of the threaded bore of the contact button.

10. The calibration mechanism of claim 8 wherein the thread pitch of the threaded bore of the crossbar is finer than the thread pitch of the threaded bore of the contact button.

11. The calibration mechanism of claim 8 wherein the lower section of the reset adjustment screw has a smaller diameter than the upper section of the reset adjustment screw.

* * * * *